US008453704B2

(12) United States Patent
Dollard

(10) Patent No.: US 8,453,704 B2
(45) Date of Patent: Jun. 4, 2013

(54) CONNECTION SYSTEM FOR WINDOW BLIND TREATMENTS

(76) Inventor: James D. Dollard, Jacksonville, FL (US)

( * ) Notice: Subject to any disclaimer, the term of this patent is extended or adjusted under 35 U.S.C. 154(b) by 0 days.

(21) Appl. No.: 13/156,992

(22) Filed: Jun. 9, 2011

(65) Prior Publication Data

US 2011/0303370 A1 Dec. 15, 2011

Related U.S. Application Data

(60) Provisional application No. 61/352,925, filed on Jun. 9, 2010.

(51) Int. Cl.
*E06B 9/262* (2006.01)

(52) U.S. Cl.
USPC ..... 160/89; 160/84.04

(58) Field of Classification Search
USPC ..... 160/89, 178.1 R, 178.3, 84.04, 264
See application file for complete search history.

(56) References Cited

U.S. PATENT DOCUMENTS

| | | | | | |
|---|---|---|---|---|---|
| 2,056,823 | A | * | 10/1936 | Brown | 160/133 |
| 3,777,800 | A | | 12/1973 | Susoev | |
| 4,934,435 | A | | 6/1990 | Regev | |
| 5,207,256 | A | | 5/1993 | Kraeutler | |
| 5,273,096 | A | * | 12/1993 | Thomsen et al. | 160/84.01 |
| 5,690,156 | A | * | 11/1997 | Ruggles | 160/84.04 |
| 5,738,159 | A | | 4/1998 | O'Brien | |
| 5,862,850 | A | * | 1/1999 | Yang | 160/84.04 |
| 6,192,961 | B1 | | 2/2001 | Martinez | |
| 6,675,859 | B2 | * | 1/2004 | Nien | 160/89 |
| 6,792,994 | B2 | * | 9/2004 | Lin | 160/84.03 |
| 7,124,802 | B2 | * | 10/2006 | Sudano | 160/89 |
| 7,195,050 | B2 | * | 3/2007 | Nien | 160/168.1 R |
| 2006/0060308 | A1 | * | 3/2006 | LeBlanc et al. | 160/84.04 |
| 2007/0175595 | A1 | * | 8/2007 | Lin | 160/84.04 |
| 2007/0246170 | A1 | * | 10/2007 | Marzilli | 160/89 |
| 2008/0179016 | A1 | | 7/2008 | Lin | |

* cited by examiner

*Primary Examiner* — David Purol

(57) ABSTRACT

An improved connection system for window blind treatments comprising tape having loops for retaining locking members. The treatment comprises a sheet member that hangs downward covering the blinds on the side away from the window. One or more strips of tape are vertically attached to the sheet member on the interior side closest to the blinds. The tape contains loops at predetermined intervals along its length. Locking members are attached to the loops of the tape and to the blind's ladders at the predetermined intervals to secure the treatment to the blinds. When secured, the treatment will raise and lower when the blinds are raised and lowered. Rods are inserted through the locking members and rod pocket and extend horizontally across the sheet member and blinds. The rods provide weight and support to the sheet member, such that when the blinds are closed, the rods and sheet member will rise with the blinds, thereby creating cascading folds in the sheet member.

16 Claims, 4 Drawing Sheets

CONNECTION SYSTEM FOR WINDOW BLIND TREATMENTS

RELATED APPLICATION

This application claims the benefit of U.S. Provisional Patent Application Ser. No. 61/352,925, filed on Jun. 9, 2010, the contents of which are hereby incorporated in their entirety by this reference.

BACKGROUND OF THE INVENTION

In recent years, one of the most popular window coverings, or shade systems, consists of horizontal vanes or blinds that are adjustable by the use of louvers mounted on vertical ladders connected to a head rail. The louvers are adjusted by manipulation of chords or a wand to control the amount of light passing through the shade. In most of these shade systems, the vanes, wands, and head rails are fabricated from plastic or metal, which produces an aesthetically rigid or mechanical appearance. A modern trend is to soften the appearance of the shade system with a thin cloth overlay, or treatment, intermittently attached to the shade. It is known to use horizontal rods to allow manipulation of the treatment as the blinds are raised or lowered. However, the known means for attaching the horizontal rods cause sharp and unsightly creases in the sheet member. In addition, such systems often involve intricate parts that can become entangled when the shade system is adjusted.

The present invention seeks to overcome these problems by providing a soft treatment, sometimes called a roman shade, having a simple construction permitting the treatment to fold automatically as the shade system is adjusted.

SUMMARY OF THE INVENTION

The treatment generally comprises a sheer fabric material, or sheet member, that covers and attaches to pre-installed horizontal window blinds. The sheet member is cut to the height and width of the blinds and attaches to blinds' head rail using hook and loop fastener strips. When attached, the treatment hangs downward covering the front of the blinds on the side away from the window. One or more strips of tape is vertically attached to the sheet member on the interior side closest to the blinds. The tape comprises loops disposed at predetermined intervals along the length of each tape. One such tape is commercially available and commonly called "roman tape." The tape is aligned to correspond with the blinds' ladders running vertically along the height of the blinds. Locking members are attached to the loops of the tape and to the blind's ladders at regular intervals to secure the sheet member to the blinds. When secured, the treatment will raise and lower as the blinds are raised and lowered. In one embodiment, rods are inserted at regular intervals through the locking members and extend horizontally across the treatment and blinds. The rods also adjust the height of the treatment as well as provide weight and support to the treatment. When the blinds are raised, the rods and treatment will rise with the blinds and create cascading pleats or folds.

DETAILED DESCRIPTION OF THE INVENTION

The following description of the preferred embodiment(s) is intended to be exemplary in nature and is in no way intended to limit the invention, its application, or uses.

With reference to the drawings, the system will now be described with regard for the best mode and the preferred embodiment(s). In general, the device is an improved connection system for window blind treatments, where the connection system promotes cascading folds in sheet member as the blinds are raised and lowered. An ordinary practitioner will understand that it is possible to create other variations of the following embodiments without undue experimentation.

Figure 1:
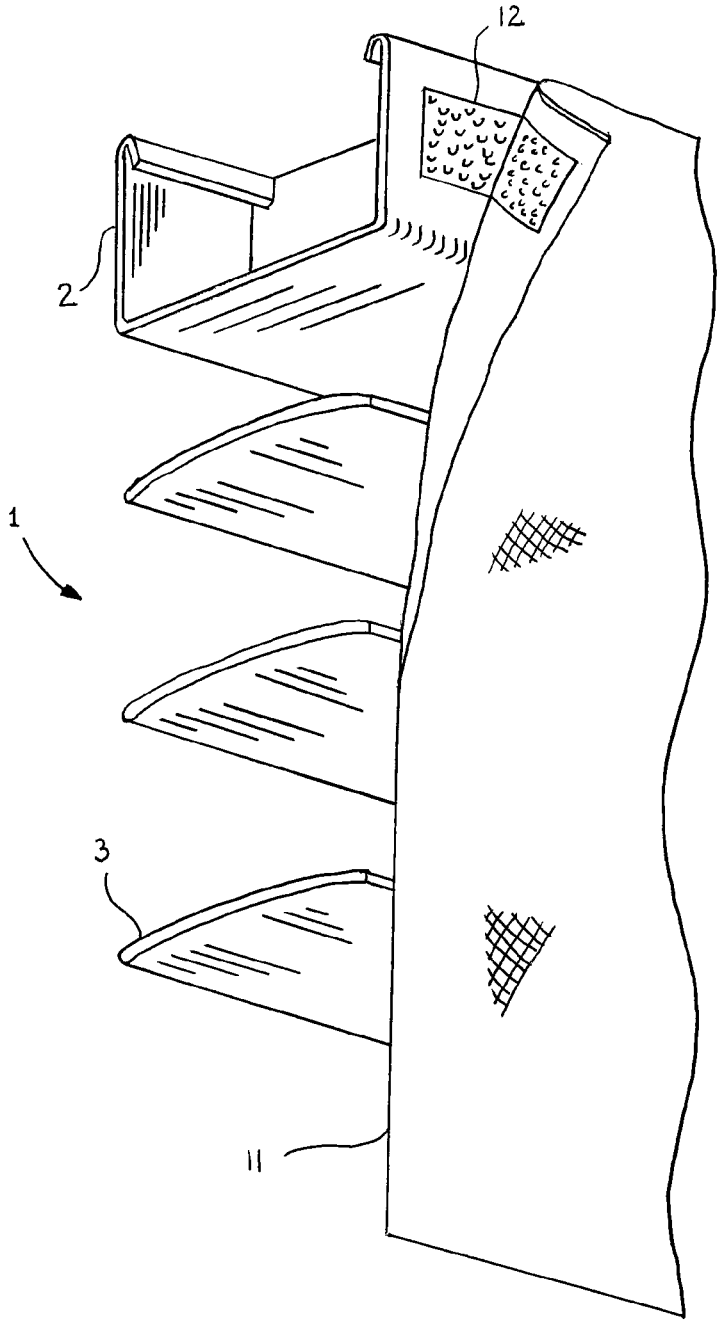
FIG. 1 is an isometric view of the blinds and treatment, showing the sheet member, vanes, and head rail.
Figure 2:
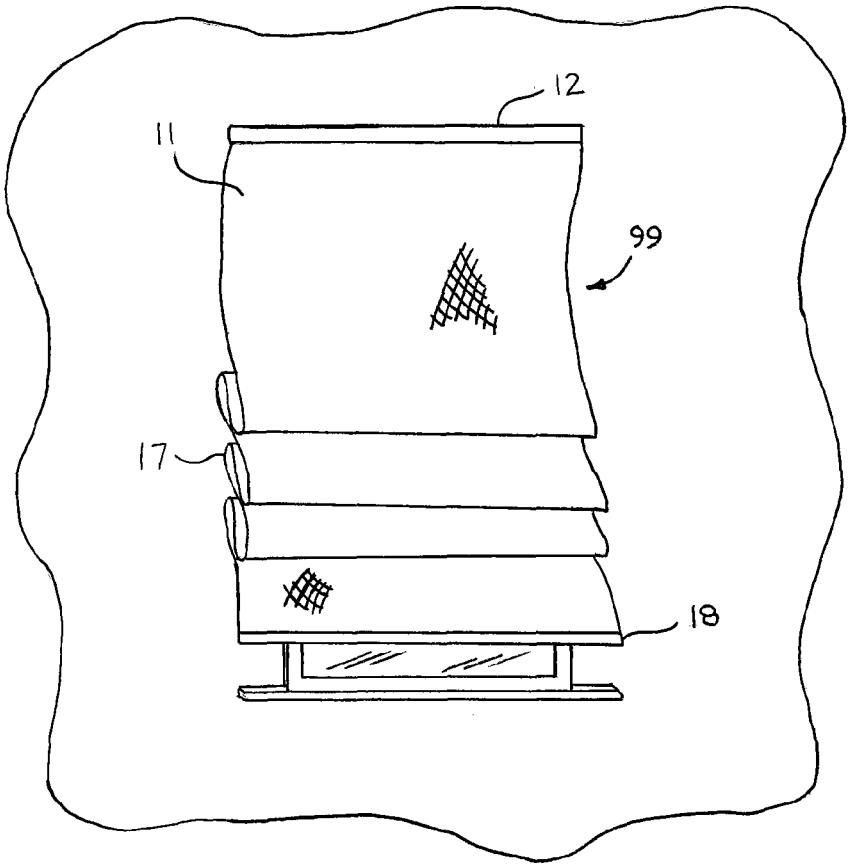
FIG. 2 is a front view of the window shade covering, showing the window treatment and cascading folds.
Figure 3:
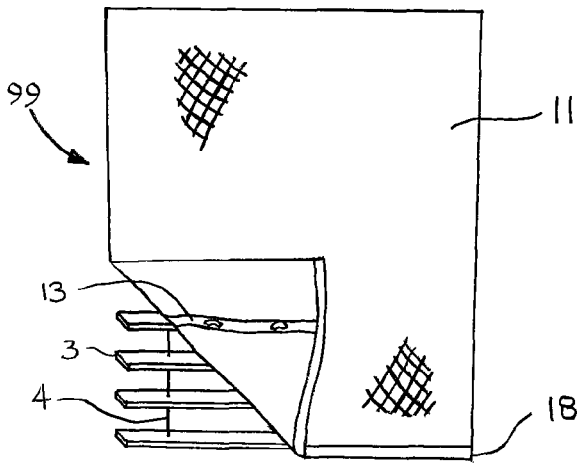
FIG. 3 shows an elevation of the window treatment having one corner pulled back to expose the blinds behind the treatment.

Referring to FIGS. 1-3, the treatment 99 is used in connection with conventional horizontal window blinds 1. These blinds 1 typically comprise a head rail 2 and horizontal vanes 3 retained by two or more ladders 4 connected to the head rail 2. For example, in Venetian blinds the horizontal vanes 3 are retained and manipulated by vertical strings forming ladders 4 through which the vanes 3 are disposed at regular vertical intervals.

Figure 5:
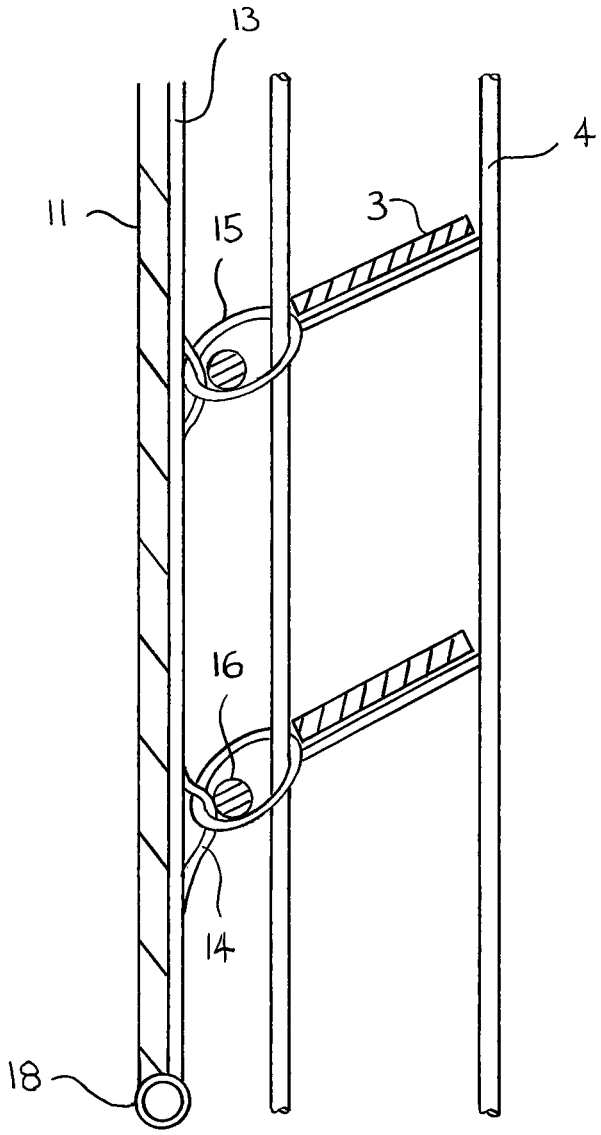
FIG. 5 is a partial cross section of the treatment and blinds, showing the sheet member, tape, loops, locking members, rods, vanes, and ladder in the lowered position.

The window treatment 99 generally comprises a sheet member 11, a top attachment means 12, one or more strips of tape 13, loops 14, and locking members 15 (see FIG. 5). The sheet member 11 is a fabric material that covers and attaches to the pre-installed horizontal window blinds 1. The sheet member 11 is cut to the height and width of horizontal blinds 1 or otherwise configured for fitting over or covering a variety of blinds 1 sizes and orientations. The sheet member 11 attaches to blinds' head rail 2 via the top attachment means 12, which is any means for removably or permanently attaching the top of the sheet member 11 to the head rail 2. The top attachment means 12 could comprise hook and loop fastener strips, glue, clips, hooks, double-sided adhesives, or any other equivalent attachment means.

The tape 13 can be any tape, strip, or ribbon-like material configured to secure the loops 14 to the sheet member 11. The tape 13 could be a single or double sided adhesive tape having loops 14 affixed to one side and an adhesive disposed on the opposite side for securing the tape 13 to the sheet member 11. For example, the tape 13 could be roman tape or shining tape. In another embodiment, the tape 13 is a fabric ribbon having loops 14 attached to one side, where the ribbon is attached to the treatment 13 by sewing or stitching.

Figure 4:
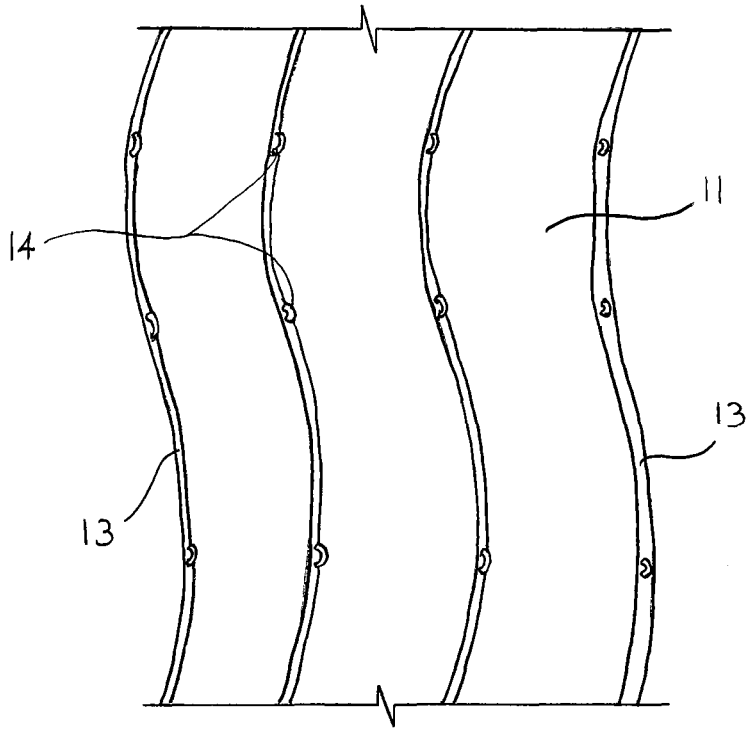
FIG. 4 shows a partial view of the inside surface of the sheet member, exposing the tape and loops to view.

When attached, the sheet member 11 hangs downward covering the blinds 1 on the side away from the window, thus exposing the sheet member 11 to the view of those occupying the room. As shown in FIGS. 4 and 5, one or more tapes 13 are vertically attached to the sheet member 11 on the interior side closest to the blinds. In one embodiment, the tapes 13 are aligned to correspond with the blinds' ladders 4 running vertically along the height of the blinds 1. Alternate placement of the tape 13 is a matter of design choice.

The tape 13 has loops 14 at predetermined intervals along its length. In one embodiment, the loops 14 are strings attached to the tape 13. The loops 14 could also comprise wire, plastic ties, or the like. The locking members 15 connect the loops 14 to the ladders 4. The locking members 15 can be a variety of circular or noncircular rings, hooks, clasps, or the like. The locking members 15 are disposed at predetermined intervals to secure the sheet member 11 to the blinds 1. In many applications, the intervals will be a regular distance compatible with the dimensions and orientation of the vanes 3 and ladders 4 in the blinds 1. In other applications, the magnitude of the intervals may be variable according to the dimensions of the blinds 1. Certain intervals may be desirable for aesthetic reasons, such as to create a certain size of cascading folds 17 in the sheet member 11, as discussed below. The intervals also may be selected to accommodate the non-uniform dimensions of custom blinds 1. However, determining the magnitude of the interval will not result in undue experimentation.

In one embodiment, the locking members 15 are configured for receiving and retaining rods 16 passing through the locking members 15 and across the sheet member 11. A rod pocket 18 can be disposed at the bottom of the treatment. In one embodiment, the rod pocket 18 is formed by folding the bottom portion of the sheet member 11 material upwards and sewing or stitching the end of the folded portion to the remaining sheet member 11 material, thereby forming a pocket across the bottom of the sheet member 11. The rods 16 extend horizontally across the sheet member 11 and blinds 1. The rods 16 provide weight and support to the sheet member 11, such that when the blinds 1 are raised, the rods 16 and sheet member 11 will rise with the blinds 1 and create cascading pleats or folds 17 in the sheet member 11. The rods 16 also provide additional weight to promote full extension of the sheet member 11 when the blinds 1 are lowered, thus reducing tangling, clumping, or snagging of the sheet member 11 as the blinds 1 are lowered. The size of the cascading folds 17 depends on the intervals at which the loops 14 and locking members 15 are placed. A longer interval creates a larger fold 17, while smaller intervals will create a greater number of smaller folds 17.

Since the loops 14, locking members 15, and rods 16 are attached to the back of the sheet member 11, persons inside the room in which the window is disposed will see only the soft appearance of the front of the sheet member 11, as shown in FIGS. 1 and 2. The connection system described herein does not create the appearance of sharp creases or folds in the sheet member 11, as do the prior art connection systems. Instead, as the blinds 1 are raised and lowered, the present connection system causes only soft, cascading folds to appear in the sheet member 11, thus creating a softer, more aesthetically pleasing appearance of the sheet member 11 and blinds 1.

The foregoing embodiments are merely representative of the apparatus and not meant for limitation of the invention. For example, one having ordinary skill in the art would understand that the individual features of several disclosed embodiments are adaptable depending on the make and orientation of the blinds 1. Consequently, it is understood that equivalents and substitutions for certain elements and components set forth above are part of the invention, and the true scope of the invention is set forth in the claims below.

I claim:

1. A connection system for a window blind treatment, said connection system comprising:

a plurality of tapes configured to vertically engage a sheet member of a window blind treatment, said sheet member configured for covering window blinds having vertical ladders for raising and lowering the blinds;

a plurality of loops disposed at predetermined intervals along each tape;

locking members configured for connecting the loops to the ladders, and further configured for receiving rods disposed horizontally; and rods disposed horizontally though the locking members, wherein the locking members retain the rods at a location distal from the sheet member such that there is no direct connection between the rods and the sheet member.

2. The connection system of claim 1, wherein the locking members are ring members for slidably receiving the rods such that each of said rods is supported by at least two locking members.

3. The connection system of claim 1, wherein the locking members are clasps for receiving and retaining the rods in place such that each of said rods is supported by at least two locking members.

4. The connection system of claim 1, further comprising means for attaching the top of the sheet member to a head rail of the window blinds.

5. The connection system of claim 2, wherein the loops, locking members, and rods are oriented such that when the blinds are lowered to the fully extended length, the loops, locking members, and rods cause the sheet member to hang freely without forming sharp creases or folds in the sheet member.

6. The connection system of claim 3, wherein the loops, locking members, and rods are oriented such that when the blinds are lowered to the fully extended length, the loops, locking members, and rods cause the sheet member to hang freely without forming sharp creases or folds in the sheet member.

7. A window blind treatment comprising:

a sheet member configured for covering window blinds having horizontal vanes and vertical ladders for raising and lowering the blinds;

a plurality of tapes vertically attached to the sheet member;

a plurality of loops disposed at predetermined intervals along each tape;

locking members configured for connecting the loops to the ladders, and further configured for receiving rods disposed horizontally; and rods disposed horizontally though the locking members, wherein the locking members retain the rods at a location distal from the sheet member such that there is no direct connection between the rods and the sheet member.

8. The connection system of claim 7, wherein the locking members are ring members for slidably receiving the rods such that each of said rods is supported by at least two locking members.

9. The connection system of claim 8, wherein the locking members are clasps for retaining the rods in place.

10. The window blind treatment of claim 9, further comprising a rod pocket disposed at the bottom of the sheet member.

11. The window blind treatment of claim 10, further comprising a means for attaching the top of the sheet member to a head rail of the window blinds.

12. A window covering comprising:

window blinds having horizontal vanes and vertical ladders for raising and lowering the blinds;

a sheet member adapted for covering the window blinds;

a plurality of tapes vertically attached to the sheet member;

a plurality of loops disposed at predetermined intervals along each tape;

locking members configured for connecting the loops to the ladders, and further configured for receiving rods disposed horizontally; and rods disposed horizontally though the locking members, wherein the locking members retain the rods at a location distal from the sheet member such that there is no direct connection between the rods and the sheet member.

13. The connection system of claim 12, wherein the locking members are ring members for slidably receiving the rods such that each of said rods is supported by at least two locking members.

14. The connection system of claim 13, wherein the locking members are clasps for retaining the rods in place.

15. The window covering of claim 14, wherein the sheet member further comprises a rod pocket disposed at the bottom of the sheet member.

16. The window covering of claim 15, further comprising a means for attaching the top of the sheet member to a head rail of the window blinds.

* * * * *